US007530218B2

(12) United States Patent
Simon et al.

(10) Patent No.: US 7,530,218 B2
(45) Date of Patent: May 12, 2009

(54) PULSED PLASMA THRUSTER USING VAPOR

(75) Inventors: Daniel H. Simon, Eldersburg, MD (US); H. Bruce Land, III, Laurel, MD (US)

(73) Assignee: The Johns Hopkins University, Balitmore, MD (US)

( * ) Notice: Subject to any disclaimer, the term of this patent is extended or adjusted under 35 U.S.C. 154(b) by 432 days.

(21) Appl. No.: 11/181,273

(22) Filed: Jul. 14, 2005

(65) Prior Publication Data

US 2008/0202093 A1 Aug. 28, 2008

Related U.S. Application Data

(60) Provisional application No. 60/587,998, filed on Jul. 14, 2004.

(51) Int. Cl.
*F03H 1/00* (2006.01)

(52) U.S. Cl. ..... 60/203.1; 60/204

(58) Field of Classification Search ..... 60/200, 60/202, 203.1, 204
See application file for complete search history.

(56) References Cited

U.S. PATENT DOCUMENTS

| | | | | |
|---|---|---|---|---|
| 3,301,038 | A | 1/1967 | Rich et al. | |
| 3,375,712 | A | 4/1968 | Postma | |
| 3,495,454 | A | 2/1970 | Heimes | |
| 3,522,726 | A | 8/1970 | Jones | |
| 3,599,480 | A | 8/1971 | Krieve | |
| 4,328,703 | A | 5/1982 | McClure et al. | |
| 4,505,153 | A | 3/1985 | Lilley et al. | |
| 4,821,508 | A * | 4/1989 | Burton et al. | 60/203.1 |
| 5,178,002 | A | 1/1993 | Hanson | |
| 5,431,045 | A | 7/1995 | Cirri | |
| 5,509,266 | A | 4/1996 | Morozov et al. | |
| 6,216,445 | B1 * | 4/2001 | Byers et al. | 60/203.1 |
| 7,302,792 | B2 * | 12/2007 | Land et al. | 60/203.1 |

OTHER PUBLICATIONS

Spanjers et al., "AFRL MicroPPT Development for Small Spacecraft Propulsion", AIAA 2002-3974, 38th AIAA/ASME/SAE/ASEE Joint Propulsion Conference and Exhibit Jul. 7-10, 2002, Indianapolis, IN.
Scharlemann et al., "Pulsed Thruster Using Water Propellant, Part I: Investigation of Thrust Behavior and Mechanism", AIAA-2003-5022, 39th AIAA/ASME.SAE/ASEE Joint Propulsion Conference Jul. 20-23, 2003, Huntsville, AL.
Scharlemann, et al., "Pulsed Plasma Thruster Using Water Propellant, Part II: Thruster Operation and Performance Evaluation", AIAA 2003-5023, 39th AIAA/ASME.SAE/ASEE Joint Propulsion Conference Jul. 20-23, 2003 Huntsville, AL.

* cited by examiner

*Primary Examiner*—Louis J Casaregola
(74) *Attorney, Agent, or Firm*—Aisha Ahmad

(57) ABSTRACT

A pulsed plasma thruster (PPT) and a method of making the PPT are disclosed. The PPT includes no moving parts and can be made in a small size. The PPT can achieve long operating duration by using vapor as a fuel. Liquid used to form the vapor can be easily stored and can provide an ample supply of vapor. The PPT is also designed to facilitate easy and rapid manufacture. The process for making the PPT uses known techniques for making printed circuit board devices.

12 Claims, 11 Drawing Sheets

PULSED PLASMA THRUSTER USING VAPOR

CROSS REFERENCE TO RELATED APPLICATIONS

This application claims the benefit of U.S. Provisional Patent Application No. 60/587,998, filed on Jul. 14, 2004. This Provisional Patent Application is hereby incorporated by reference in their entirety.

BACKGROUND OF THE INVENTION

1. Field of the Invention

This invention relates to a Pulsed Plasma Thruster ("PPT") and a method for making a PPT.

2. Related Art

As satellites become smaller and as larger satellites require highly precise motion control, a need arises for smaller thrusters. PPTs have been proposed for use in these kinds of applications and many different PPT designs have been attempted.

Spanjers (U.S. Pat. No. 6,269,629) discloses a micro-PPT that uses a coaxial cable configuration. Spanjers uses the insulation of the cable or the spacer, made of a copolymer, disposed between a cylindrical outer conductor and an inner conductor as the fuel.

Spanjers (U.S. Pat. No. 6,153,976) discloses a PPT that replaces a spark igniter with a mechanical switch that contacts the face of an electrically conductive propellant. This reference also provides a background description of PPT's in general.

Burton et al. (U.S. Pat. No. 4,821,509) discloses a pulsed electrothermal thruster. This invention attempts to provide conditions that lead to electrothermally-dominated flow. Specifically, a high pressure discharge with very low ionization is disclosed. The electrical discharge includes the use of a capillary tube, but the size of the capillary is governed by the need to produce high discharge pressures.

Burton (U.S. Pat. No. 5,425,231) discloses a gas fed pulsed electric thruster. This invention is gas fed and operates at an enormously high repetition rate. This is done in order to maximize the utilization of the gas propellant. In this design, the gas propellant is constantly flowing through the device rather than shutting the gas on and off between discharges.

LaRocca (U.S. Pat. No. 3,575,003) teaches a thruster that operates by accerating gasses. LaRocca discloses a device that includes an array of radially oriented electrodes. LaRocca also discloses the use of a melted propellant that moves by the action of surface tension.

While the related art generally teaches different PPT designs, none of the references teach a compact or micro-PPT that is susceptible to easy and rapid manufacture, includes no moving parts and is easy to deploy and integrate into existing and future satellite architecture. Current designs employ springs or other mechanical devices that are used to convey or advance a solid fuel bar. These springs or other mechanical devices can be very difficult or impractical to use on very small scales. Also, related art PPT's have limited fuel capacity, reducing their operating duration.

SUMMARY OF THE INVENTION

An improved PPT that overcomes one or more shortcomings of related PPTs is proposed. In one aspect, the invention provides A PPT comprising: a vapor supply in fluid communication with an upstream plenum through a first vapor hole, the vapor supply providing vapor to the upstream plenum; a membrane disposed in the first vapor hole configured to provide a pressure difference between the vapor supply and the upstream plenum; the upstream plenum in fluid communication with a PPT chamber through a second vapor hole; where the upstream plenum includes first and second electrodes configured to provide a spark within the upstream plenum; and where the PPT chamber includes a first PPT electrode and a second PPT electrode, the first and second PPT electrodes configured to ionize material in the PPT chamber.

In another aspect, the membrane is made of silver.

In another aspect, the membrane is made of a sintered silver material.

In another aspect, the membrane helps to prevent backflow of vapor from the upstream chamber to the vapor supply.

In another aspect, a longitudinal axis of the PPT chamber is coaxial with the upstream plenum.

In another aspect, a longitudinal axis of the PPT chamber different than the longitudinal axis of the upstream plenum.

In another aspect, the first and second PPT electrodes are formed by two bores separating electrode side portions.

In another aspect, the PPT chamber is formed by two ceramic plugs inserted into the two bores.

In another aspect, the invention provides a method for operating a PPT comprising the steps of: moving vapor through a first vapor hole, that includes a membrane, and into an upstream plenum; providing a spark in the upstream plenum to increase the pressure of the vapor and moving the pressurized vapor through a second vapor hole and into a PPT chamber; ionizing the pressurized vapor in the PPT chamber by utilizing a voltage difference provided by a first PPT electrode and a second PPT electrode to produce plasma; and evacuating the plasma out of the PPT chamber through a PPT nozzle.

In another aspect, the spark is provided by a first electrode and a second electrode associated with the upstream plenum.

In another aspect, the membrane includes silver.

In another aspect, the membrane is made of a sintered silver material.

In another aspect, the invention provides a method of making a PPT comprising the steps of: forming a first hole in a vapor body end plate; forming a second hole in a first plenum end plate; disposing a membrane between a vapor body end plate and a first plenum end plate so that the membrane intersects with both the first hole and the second hole; associating the vapor body end plate with the first plenum end plate; and attaching a plenum body plate that includes an upstream plenum with the first plenum end plate.

In another aspect, the step of attaching a second plenum end plate to the plenum body plate.

In another aspect, a first electrode and a second electrode are disposed on the second plenum end plate prior to attaching the second plenum end plate to the plenum body plate.

In another aspect, the step of associating a thruster plate with the plenum body plate.

In another aspect, the thruster plate includes a PPT chamber having a longitudinal axis substantially aligned with a longitudinal axis of the upstream plenum.

In another aspect, a PPT chamber is formed with a longitudinal axis that is substantially different than a longitudinal axis of the upstream plenum.

In another aspect, a thruster plate is formed with an elbow passage that directs incoming vapor into a different direction.

In another aspect, the step of separating a conductive plug into a first portion and a second portion.

In another aspect, a pair of bores drilled into the conductive plug separates the first portion from the second portion.

In another aspect, an inert member is inserted between the first portion and the second portion to define sidewalls of the PPT chamber.

In another aspect, the invention provides a method of operating a PPT comprising the steps of: receiving vapor in a PPT chamber at a first pressure; receiving vapor in a PPT chamber at a second pressure, the second pressure being higher than the first pressure; passing vapor at the first pressure through the PPT chamber; the exiting vapor having substantially similar properties as incoming vapor; and ionizing vapor that is at the second pressure in the PPT chamber and converting the vapor the second pressure into plasma.

In another aspect, vapor pressure is varied in an upstream plenum disposed upstream from the PPT chamber.

In another aspect, at least one electrode associated with the upstream plenum is used to vary vapor pressure.

In another aspect, vapor is delivered in the upstream plenum from a vapor supply through a membrane.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENT(S)

Figure 1:
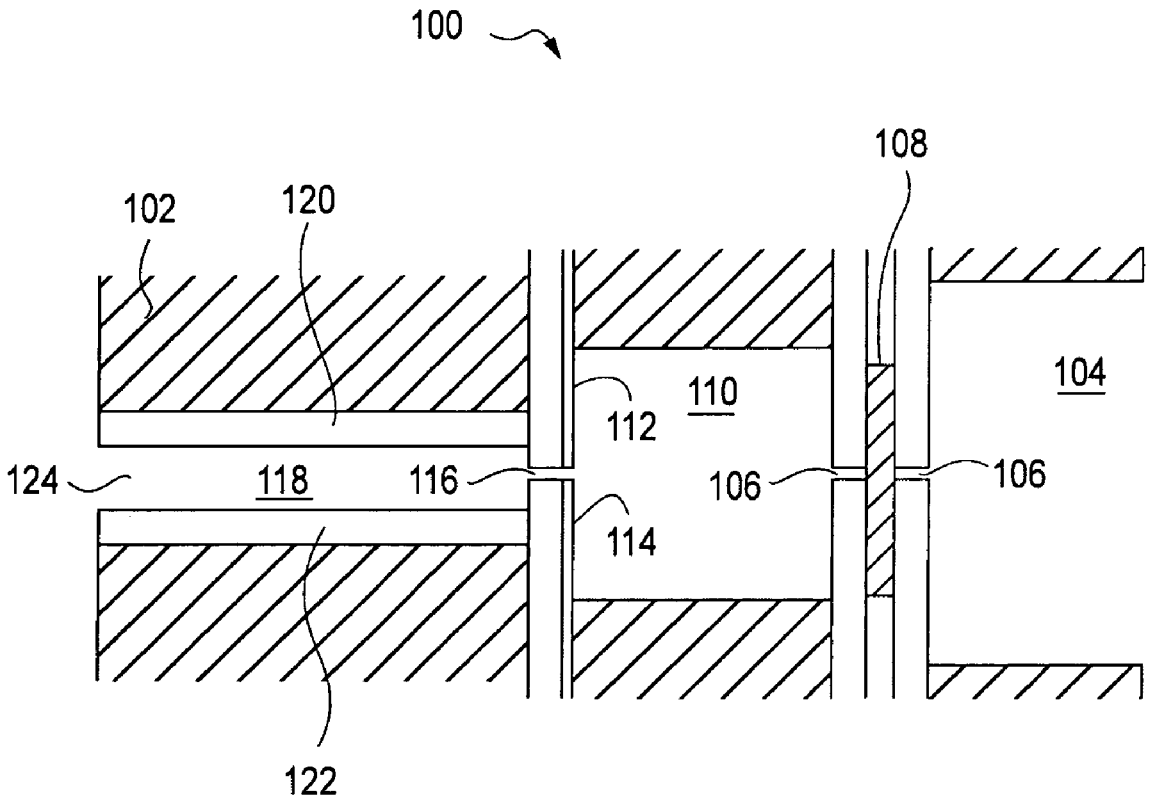
FIG. 1 is a schematic diagram of a cross-sectional view of a preferred embodiment of a PPT.

FIG. 1 is a cross-sectional schematic diagram of a preferred embodiment of Pulsed Plasma Thruster (PPT) 100. PPT 100 includes a housing 102 that is used to support and associate various components.

Preferably, PPT 100 uses a vapor or gas as a propellant fuel. In the embodiment shown in FIG. 1, PPT 100 includes a vapor supply 104, which can assume many different forms. In some embodiments, vapor supply 104 includes a pressurized vapor, in other embodiments, vapor supply 104 includes a liquid that converts to vapor due to changes in pressure or temperature.

Regardless of the specific way in which vapor is provided, vapor supply 104 preferably communicates with upstream plenum 110 through first vapor hole 106. Although PPT 100 can be made in any suitable scale or size, PPT 100 is preferably relatively small and in exemplary embodiments, first vapor hole 106 is about 0.015 to 0.025 inches in diameter.

Preferably, first vapor hole 106 includes a flow regulating device 108. Flow regulating device 108 preferably allows vapor to pass from vapor supply 104 to upstream plenum 110 while inhibiting the flow of liquid from vapor supply 104 to upstream plenum 110. In some embodiments, the flow regulating device 108 can help to prevent back flow from upstream plenum 110 to vapor supply 104.

Although many devices or materials could serve as the flow regulating device, preferred embodiments use a membrane 108. Preferably, membrane 108 has the desired flow characteristics discussed above. In an exemplary embodiment, membrane 108 includes a silver material. In an exemplary embodiment, membrane 108 is made of a sintered silver material that can be formed using powder metallurgy techniques. Preferably, this sintered silver material allows vapor to pass from vapor supply 104 to upstream plenum 110, while helping to inhibit the flow of liquid from vapor supply 104 to upstream plenum 110.

In some embodiments, membrane 108 allows vapor to continuously pass, at a low flow rate, from vapor supply 104 to upstream plenum 110. Vapor accumulates in upstream plenum 110 and, as upstream plenum 110 fills with vapor, the vapor eventually passes through PPT chamber 118. The amount of vapor passively passing through PPT chamber 118 is preferably not sufficient to activate or produce an arc between first electrode 120 and second electrode 122. Instead, the vapor simply passes through PPT chamber 118 and exits through PPT nozzle 124.

Upstream plenum 110 can be used as a pre-ionization chamber. Preferably, upstream plenum 110 prepares vapor for eventual ionization in later stages. Upstream chamber 110 can also be used to draw vapor from vapor supply 104, thus helping to fuel for subsequent ionization events.

Preferably, upstream plenum 110 includes provisions that assist in preparing and delivering vapor within upstream plenum 110 for subsequent ionization. In a preferred embodiment shown in FIG. 1, upstream plenum 110 includes first electrode 112 and second electrode 114. These electrodes 112 and 114 can introduce a spark within upstream plenum 110, and this spark can, in turn, help to pressurize the vapor that is currently contained within upstream plenum 110.

Once the vapor within upstream plenum 110 has been pressurized, the vapor is urged out of second vapor hole 116 and into PPT chamber 118. Membrane 108 helps to prevent vapor from flowing back into vapor supply 104.

Pressurized vapor continues to enter PPT chamber 118 until a sufficient amount of vapor within PPT chamber 118 causes an arc between first PPT electrode 120 and second PPT electrode 122, which have been charging and accumulating a potential difference. Unlike the passive leakage of vapor through PPT chamber 118, the pressurized vapor is of sufficient density to activate first electrode 120 and second electrode 122.

In some embodiments, first and second electrodes 120 and 122 are designed to achieve a potential difference of about 500 to 600 Volts in a vacuum. The arc causes the pressurized vapor to ionize or dissociate into plasma, which is then ejected through PPT nozzle 124. This generally occurs because PPT nozzle 124 is preferably larger, in terms of area, than second vapor hole 116. This also occurs because the magnetic field generated by the electrical arc imposes a Lorentz force on the ionized vapor that accelerates it in the direction of the PPT nozzle 124. The ejection of plasma provides a reaction force on housing 102. In the embodiment shown in FIG. 1, the reaction force would tend to push housing 102 to the right. In this way, PPT 100 can provide thrust.

It can be observed that thrust pulse events are controlled by controlling pressure of vapor delivered to PPT chamber 118. If passively leaked vapor at low pressure is delivered to PPT chamber 118, then PPT chamber 118 does not provide an ionization event. On the other hand, if pressurized vapor is delivered to PPT chamber 118, then the pressurized vapor is of sufficient density to trigger an ionization event within PPT chamber 118.

In operation, vapor is continuously leaking from vapor supply 104, through membrane 108 in first vapor hole 106 into upstream plenum 110. From here, vapor is continuously leaked from upstream plenum 110, through second vapor hole 116 and into PPT chamber 118. If a thrust pulse is desired, vapor in upstream plenum 110 is pressurized by first electrode 112 and second electrode 114. This causes pressurized vapor to be delivered to PPT chamber 118. This pressurized vapor is of sufficient density to trigger an ionization event within PPT chamber 118. In this embodiment, it can be observed that thrust pulses are controlled or activated by controlling first electrode 112 and second electrode 114 in upstream plenum 110.

Figure 2:
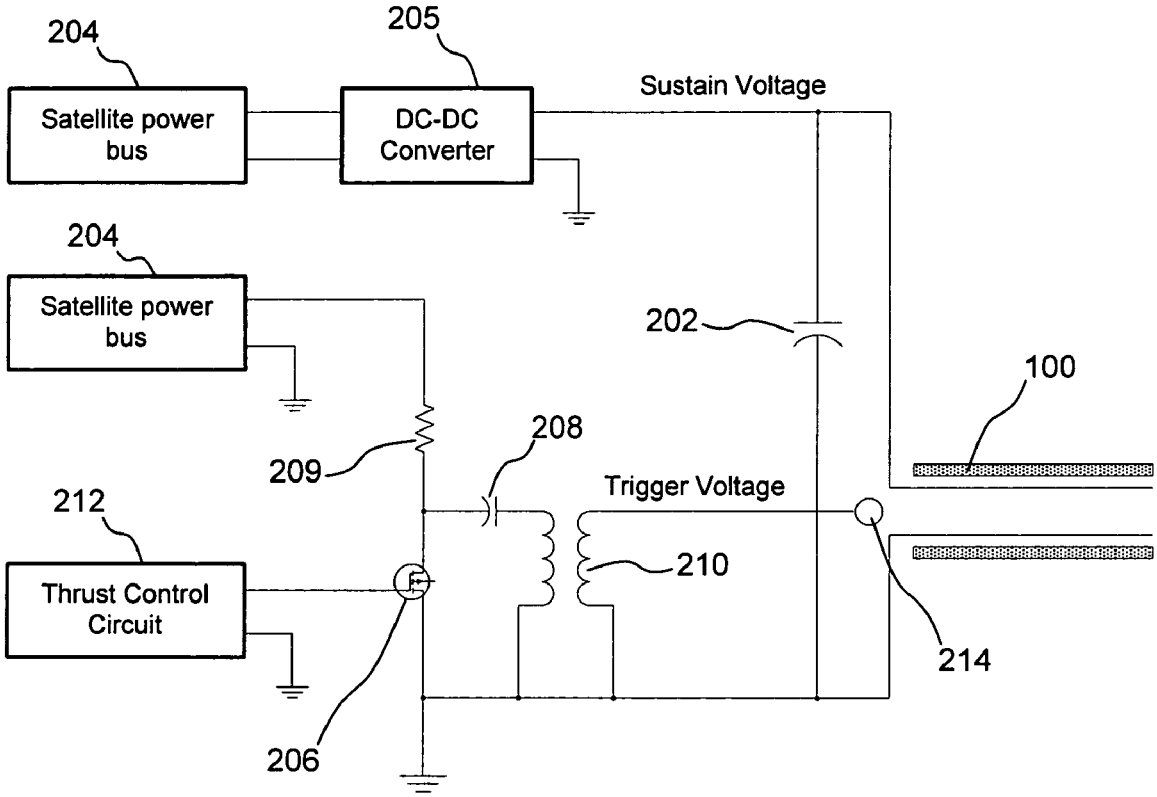
FIG. 2 is a schematic diagram of a preferred embodiment of an electrical system for a PPT.

In addition to the structures disclosed above, PPT 100 preferably also includes provisions that assist in ionizing vapor. These provisions can include an electrical system that provides energy and power to various components of PPT 100. FIG. 2 is a schematic diagram of a preferred embodiment of an electrical system 200 supporting PPT 100. Electrical system 200 includes a main discharge capacitor 202, which is also referred to as a sustain capacitor, connected to satellite bus 204. In some embodiments, an optional converter 205 is provided. Converter 205 can adjust or step up the power provided by satellite bus 204 to a desired or required power output. In some embodiments, converter is a step up DC-DC converter that increases the output voltage. Satellite power bus 204 is typically 28 VDC, but the circuit components can be selected to work with any voltage, including from 1.5 VDC and higher.

A trigger device 206 is connected to a spark capacitor 208 and to satellite bus 204. Preferably, trigger device 206 is a low impedance, high current solid state switch (such as a MOSFET device). In some embodiments, a resistor 209 is provided. In the embodiment shown in FIG. 2, a current limiting resistor 209 is provided between satellite power bus 204 and spark capacitor 208. Spark capacitor 208 is preferably connected to either first electrode 112 or second electrode 114 via electrical connector 214. In some embodiments, a transformer 210 is provided between spark capacitor 208 and either first electrode 112 or second electrode 114.

Referring to FIGS. 1 and 2, in stand by, trigger device 206 is open and does not pass current. This allows spark capacitor 208 to charge through resistor 209. In operation, trigger device 206 receives a signal from thrust control circuit 212. This causes spark capacitor 208 to discharge through transformer 210 generating a high voltage trigger. The trigger voltage initiates operation of first electrode 112 and second electrode 114, and this causes a spark to occur in upstream plenum 110. Electrical system 200 and spark capacitor 208 are designed so that this spark causes a mass of high pressure vapor to be ejected from upstream plenum 110 and into PPT chamber 118 where an ionization occurs, as disclosed above.

The first ablation event, in turn, causes main discharge capacitor 202 to discharge and produce a second spark in PPT chamber 118. In other words, the sustain capacitor 202 furnishes the energy for the sustain. This second spark helps to ionize the pressurized vapor in PPT chamber 118 and convert the pressurized vapor into plasma. Once the plasma reaches the PPT nozzle 124, the energy from main discharge capacitor 202 is expended and the arc between the two PPT electrodes 120 and 122 extinguishes. Since current is no longer flowing through PPT 100, main discharge capacitor 202 can recharge from converter 205 or satellite power bus 204. Thrust control circuit 212 turns trigger device 206 off and spark capacitor 208 is recharged, preferably, through resistor 209. The repetition of this operation is controlled by thrust control circuit 212, which can control how many pulses per second and for how long (usually in terms of seconds) pulses are generated to create the overall thrust desired.

Figure 3:
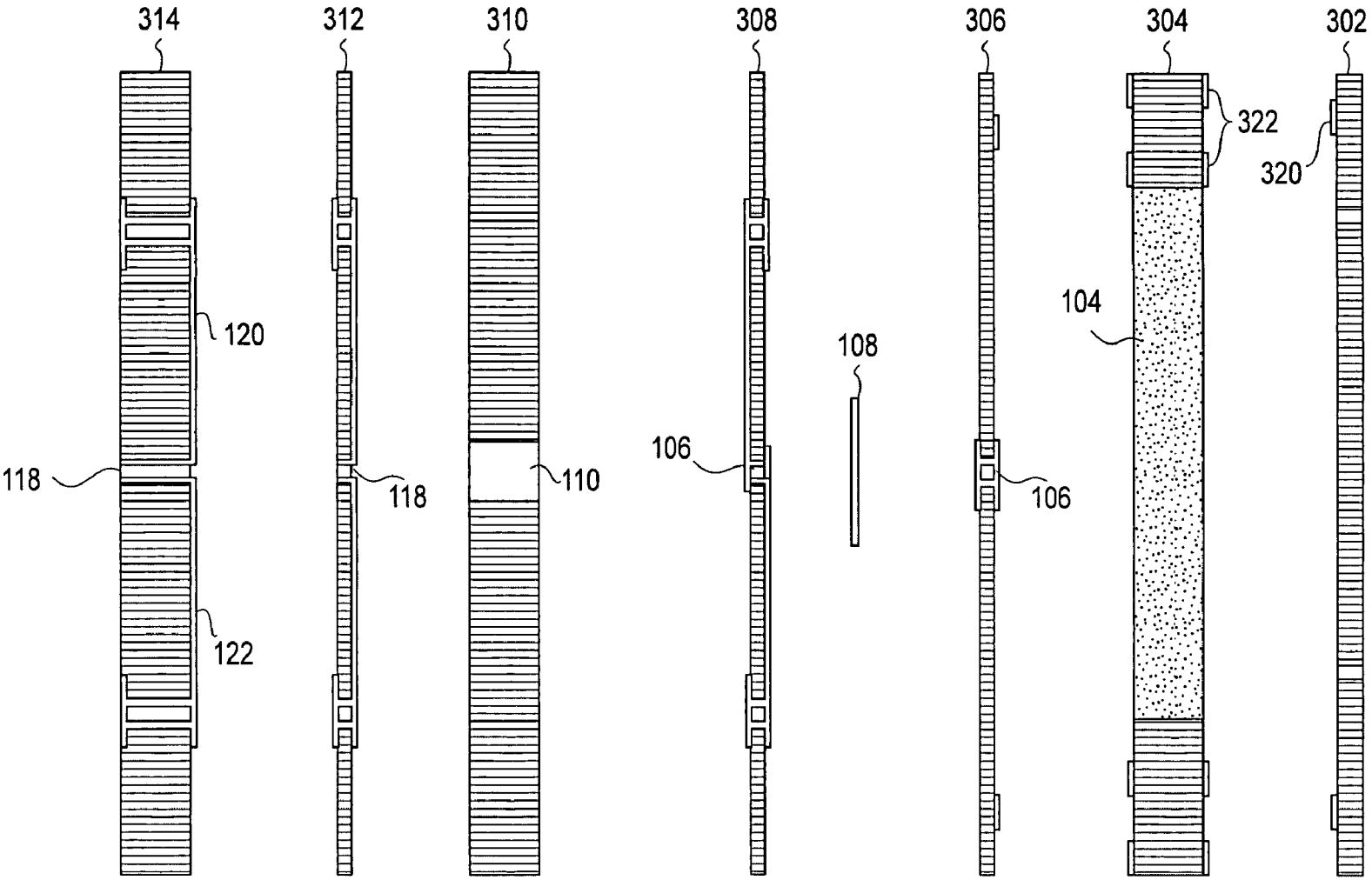
FIG. 3 is a schematic diagram of an exploded view of a preferred embodiment of a PPT during assembly.

Preferbly, PPT 100 is designed so that the device is susceptible to manufacture. FIG. 3 is an exploded assembly diagram of PPT 100. Although PPT 100 can be made in many different ways, the following assembly procedure using conventional printed circuit board technology is preferred. Back plate 302 is attached to the rear side of vapor supply body plate 304 and vapor supply body end plate 306 is attached to the forward side of vapor supply body plate 304. After assembly these three plates form vapor supply 104. Preferably, vapor supply body end plate 306 includes first vapor supply hole 106.

Membrane 108 is disposed between vapor supply body end plate 306 and first plenum end plate 308. Preferably, first plenum end plate 308 includes a hole aligned with first vapor hole 106 on vapor supply body end plate 306. The hole 106 on first plenum end plate 308 serves as a continuation of first vapor hole 106. Preferably, membrane 108 is disposed across first vapor hole 106 and is generally coaxial with first vapor hole 106.

First plenum end plate 308 is attached to the rear side of plenum body plate 310 while second plenum end plate 312 is attached to the forward side of plenum body plate 310. These three plates 308, 310 and 312 are used to form upstream plenum 110. Preferably, second plenum end plate 312 includes a hole that serves as second vapor hole 116. As shown in FIG. 3, second plenum end plate 312 preferably includes first electrode 112 and second electrode 114. Preferably, both first electrode 112 and second electrode 114 are disposed on second plenum end plate 312.

Second plenum end plate 312 is preferably attached to thruster plate 314. Preferably, thruster plate 314 includes an aperture that is used as PPT chamber 118. Preferably, PPT chamber 118 is generally aligned with second vapor hole 116, and in an exemplary embodiment, PPT chamber 118 is coaxial with second vapor hole 116. Preferably, first PPT electrode 120 and second PPT electrode 122 are disposed on thruster plate 314.

After all of the plates have been assembled, the preferred method of making PPT 100 results in a device that is structural similar to PPT 100 shown in FIG. 1. Any desired fastener and/or adhesive can be used to associate or join the various plates with one another. In some embodiments epoxies are used and in a preferred embodiment prepreg is used to join the various plates together. After all of the plates have been assembled, the preferred method of making PPT 100 results in a device that is structural similar to PPT 100 shown in FIG. 1. Any desired fastener and/or adhesive can be used to associate or join the various plates with one another. In some embodiments epoxies are used and in an preferred embodiment prepreg is used to join the various plates together.

Some embodiments include provisions that help to reduce the leakage of fluids or liquids. These provisions can include overlapping copper ridges or electron traces disposed on one or more of the plates. As shown in FIG. 3, back plate 302 can include first copper ridge 320. Preferably, first copper ridge 320 is designed to mate with second copper ridges 322 disposed on vapor supply body plate 304. The first and second copper ridges 320 and 322 are designed to interdigitate with one another in order to help form a fluid seal. Similar copper ridges can be disposed on the forward side of vapor supply body plate 304 and vapor supply body end plate 306. These same copper ridges can also be disposed on any other plate pairs.

Some embodiments include provisions to provide heat to first vapor hole 106. In embodiments that provide a provision for heating first vapor hole 106, heating conductors 324 are provided on first plenum end plate 308. Heating conductors 324 can be used to heat first vapor hole 106 and thereby heat the vapor passing through first vapor hole 106. This can be done to help the vapor achieve a desired temperature and/or pressure prior to reaching upstream plenum 110.

Figure 4:
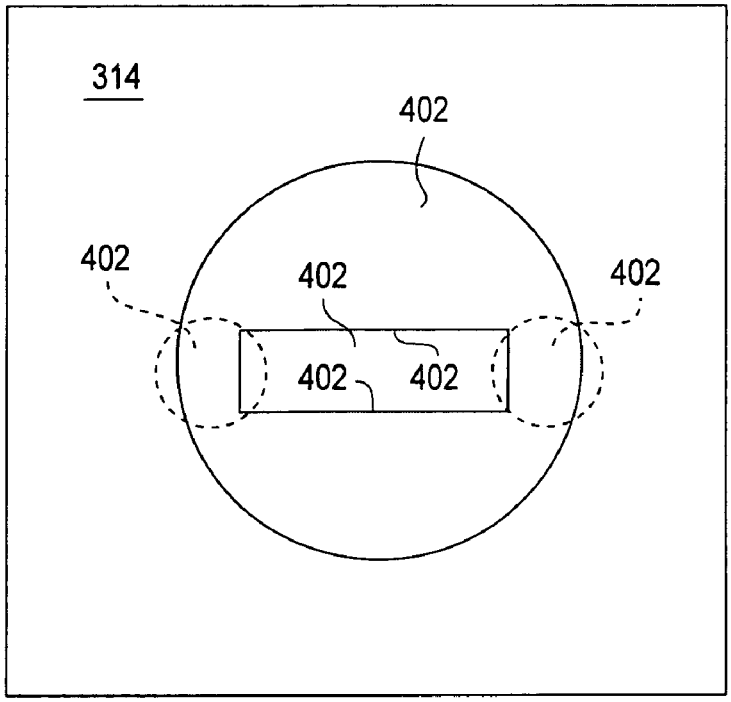
FIG. 4 is a schematic diagram of a front view of a preferred embodiment of a PPT chamber during an intermediate assembly step.
Figure 5:
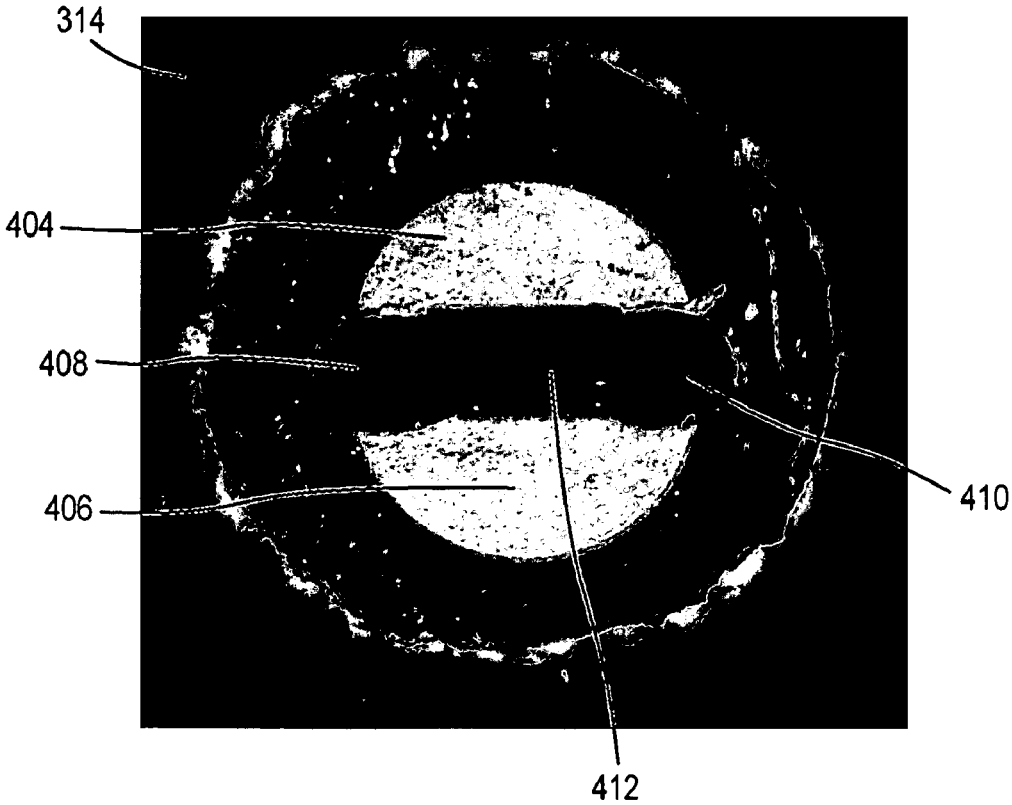
FIG. 5 is a schematic diagram of a front view of a preferred embodiment of a PPT chamber.
Figure 6:
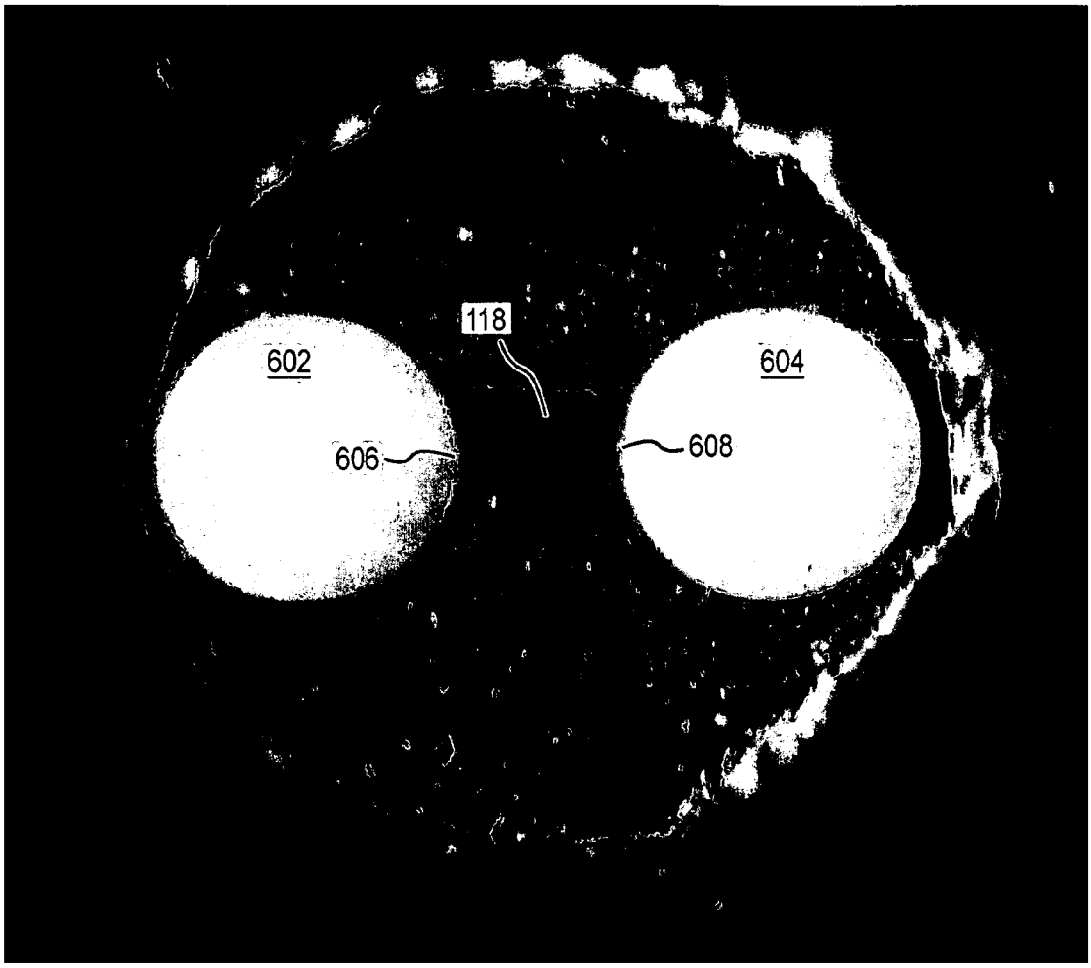
FIG. 6 is a schematic diagram of a front view of a preferred embodiment of a PPT chamber.

PPT chamber 118 can be formed in many different ways. FIGS. 4-6 are schematic diagrams showing a preferred embodiment of steps that can be used to form PPT chamber 118. Referring to FIGS. 4-6, the method for forming PPT chamber 118 preferably begins by inserting conductive plug 402 in a bore drilled into thruster plate 314. Preferably, conductive plug 402 includes a passageway 412. This passageway 412 can come in many different shapes or configurations, however, a square or generally rectangular passageway 412 that is generally centrally located within conductive plug 402 is preferred. Passageway 412 includes an upper surface 414 and a lower surface 416.

In order to separate the upper surface 414 from lower surface 416, a pair of bores are used. As shown in FIG. 5, first bore 408 and second bore 410 are drilled or otherwise formed into conductive plug 402. These bores 408 and 410 separate upper surface 414 from lower surface 416. The bores 408 and 410 also have the effect of dividing conductive plug 402 into a first portion 404 and a second portion 406. These portions 404 and 406 are not in contact with one another, and effectively form separate conductors. By dividing conductive plug 402 into two separate conductors, these two separate conductors, first potion 404 and second portion 406, can serve as the electrodes of PPT 118. In a preferred embodiment, first portion 404 serves as first PPT electrode 120 (See FIG. 1) and second portion 406 serves as second electrode 122 (see FIG. 1).

It has been discovered that first bore 408 and second bore 410 introduce surface irregularities and surface flaws into upper surface 414 and lower surface 416. These surface flaws can adversely affect the performance of PPT 118 by reducing the ability of first portion 404 and second portion 406 to maintain a potential difference. In order to alleviate these drawbacks, a second embodiment, shown in FIG. 6, includes provisions for reducing the influence of the surface flaws associated with first bore 408 and second bore 410.

The second embodiment includes a first inert member 602 inserted into first bore 408 and a second inert member 604 inserted into second bore 410. These inert members 602 and 604, provide sidewalls to PPT chamber 118. As shown in FIG. 6, first inert member 602 provides a first sidewall 606, and second inert member 604 provides a second sidewall 608.

These sidewalls 606 and 608 help to define PPT chamber 118 and prevent vapors from entering regions where surface irregularities have been formed by first bore 408 and second bore 410. By limiting the vapors to the regions unaffected by first bore 408 and second bore 410, first portion 404 presents a smooth upper surface 614 to PPT chamber 118, and likewise, second portion 406 presents a smooth lower surface 616 to PPT chamber 118. This helps to maintain PPT chamber 118 in good working order, and this helps first portion 404 and second portion 406 maintain acceptable potential differences for many ionization cycles or events.

Figure 7:
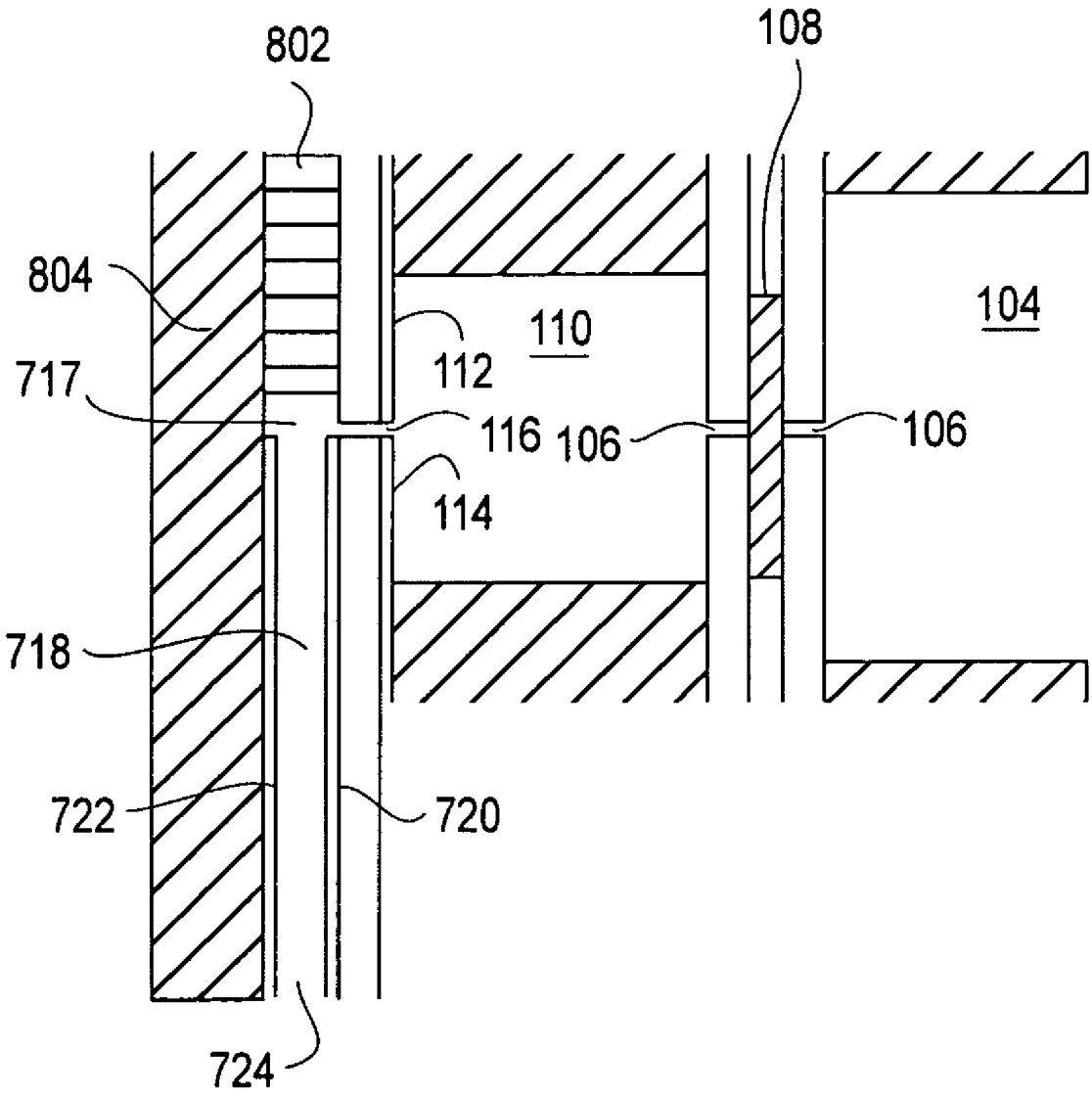
FIG. 7 is a schematic diagram of a cross-sectional view of a preferred embodiment of a PPT.

PPT 700 can me made in many different configurations and can provide thrust in many different directions. FIG. 7 is a schematic cross-sectional diagram of a preferred embodiment of PPT with an edge firing nozzle design. PPT 700 is generally similar to PPT 100 up to second vapor hole 116. In other words, PPT 700 is generally similar to PPT 100 except for portions that are downstream of second vapor hole 116. Thus, PPT 700 includes an upstream plenum 110 with associated first electrode 112 and second electrode 114. PPT 700 also includes second vapor hole 116 that is similar to first PPT 100.

However, PPT 700 differs from PPT 100 downstream of second vapor hole 116. Unlike PPT 100, PPT 700 includes a different kind of PPT chamber 718 and also includes a different PPT electrode configuration. Portions of PPT 700 are also preferably made using different components and different techniques.

As shown in FIG. 7, PPT chamber 718 extends in a direction that is generally different than the longitudinal axis of upstream plenum 110. This is in contrast to the embodiment shown in FIG. 1, where PPT chamber 118 extends in a direction that is generally similar to the longitudinal axis of upstream plenum 110.

In order to direct the vapor exiting second vapor hole 116, PPT 700 includes an elbow passage 717 that directs the vapor in a direction that is different than the longitudinal axis of upstream plenum 110. Elbow passage 717 can direct the vapor in any desired direction. In some embodiments, elbow passage 717 is straight and directs vapor in a direction similar to the longitudinal axis of upstream plenum 110. However, in the exemplary embodiment, elbow passage 717 directs the vapor in a direction that is generally perpendicular to the longitudinal axis of upstream plenum 110.

The downstream portion of elbow passage 717 is in fluid communication with PPT chamber 718. PPT chamber 718 includes a first PPT electrode 720 and a second PPT electrode 722. Preferably, these two PPT electrodes 720 and 722 maintain a suitable potential difference that is capable of ionizing pressurized vapor into plasma.

PPT 700 generally operates in a manner similar to PPT 100, described above. PPT 700 is continuously leaking low pressure vapor through upstream plenum 110, elbow passage 717, and through PPT chamber 718. In those instances where an ionization event is desired, first and second electrodes 112 and 114 associated with upstream plenum 110 provide a spark. This spark pressurizes the vapor contained in upstream plenum 110. The pressurized vapor then exits second vapor hole 116 and past elbow passage 717. Like PPT 100, pressurized vapor flow back through first vapor hole is inhibited by membrane 108.

As pressurized vapor flows into PPT chamber 118 and accumulates, eventually enough pressurized vapor enters PPT chamber 118 so that first PPT electrode 720 and second PPT electrode 722 arc, releasing their electrical potential energy and ionizing the pressurized vapor into plasma. This plasma exits PPT nozzle 724 and provides a reaction force onto housing 702. This reaction force generally extends in the same direction as the longitudinal axis of PPT chamber 718 and is directed in the opposite direction as the direction of the exiting plasma. In the embodiment shown in FIG. 7, plasma would exit nozzle 724 in a generally downward direction, and the reaction force of this exiting plasma would act in the opposite direction: upwards as shown in FIG. 7. This would provide a thrust in the upward direction to housing 702.

Figure 8:
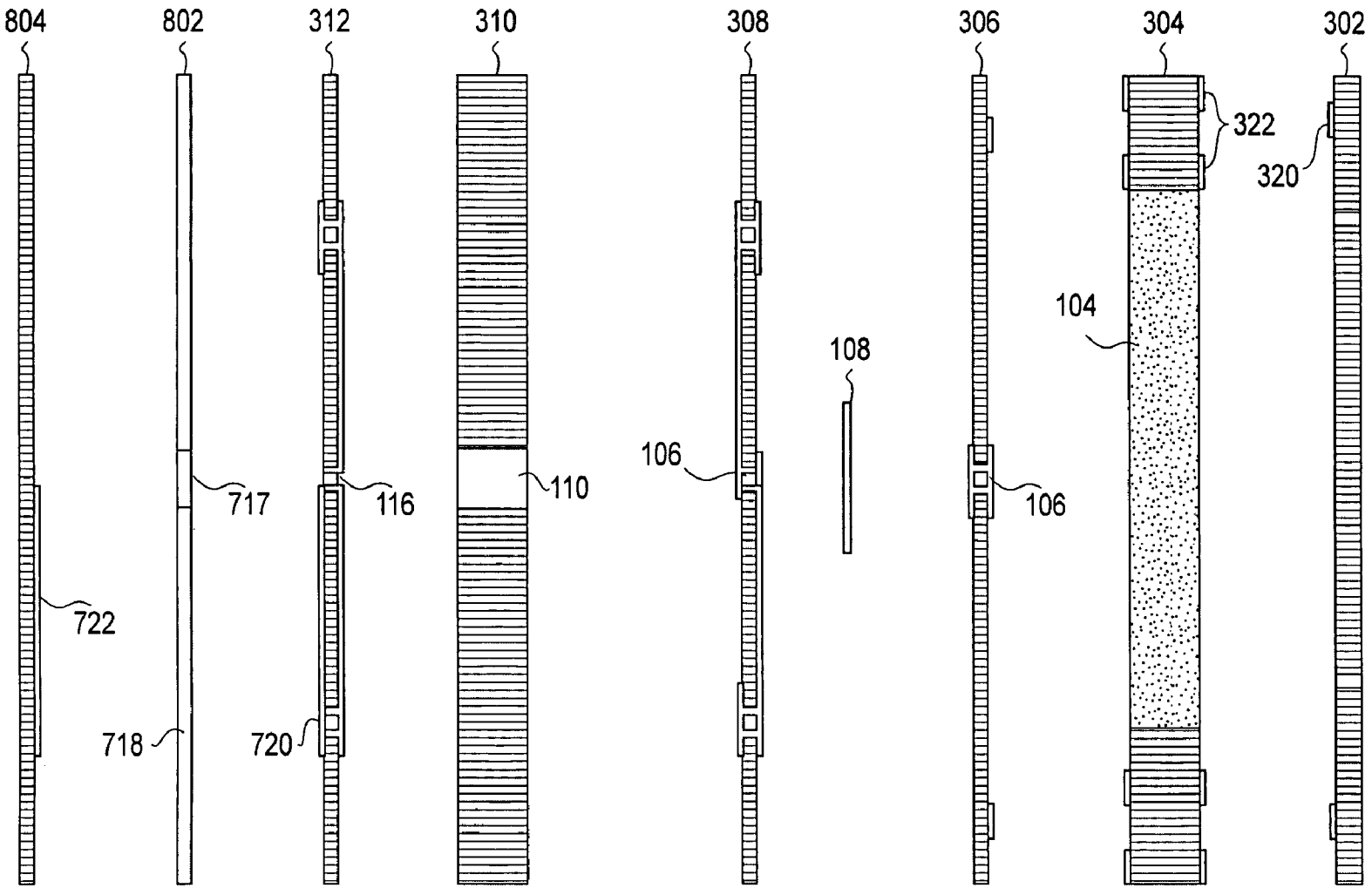
FIG. 8 is a schematic diagram of an exploded view of a preferred embodiment of a PPT during assembly.
Figure 9:
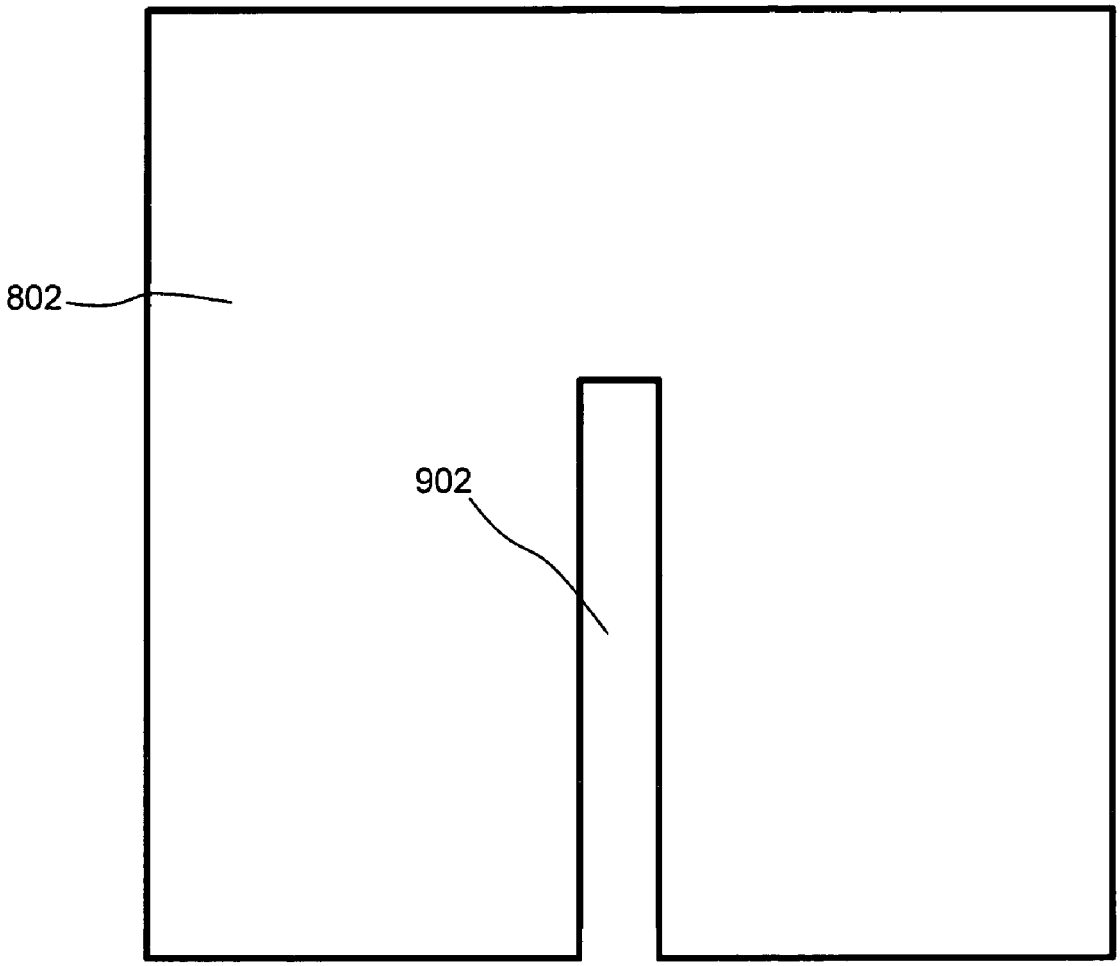
FIG. 9 is a schematic diagram of a top view of a preferred embodiment of a thrust plate.

Like PPT 100, PPT 700 can be made in a variety of different ways. However, the following method is preferred. Referring to FIG. 8, which is an exploded schematic assembly diagram of a preferred embodiment of PPT 700, various plates are shown. Although PPT 700 can be made in many different ways, the following assembly procedure using conventional printed circuit board technology is preferred. Back plate 302 is attached to the rear side of vapor supply body plate 304 and vapor supply body end plate 306 is attached to the forward side of vapor supply body plate 304. After assembly these three plates form vapor supply 104. Preferably, vapor supply body end plate 306 includes first vapor supply hole 106.

Membrane 108 is disposed between vapor supply body end plate 306 and first plenum end plate 308. Preferably, first plenum end plate 308 includes a hole aligned with first vapor hole 106 on vapor supply body end plate 306. The hole 106 on first plenum end plate 308 serves as a continuation of first vapor hole 106. Preferably, membrane 108 is disposed across first vapor hole 106 and is generally coaxial with first vapor hole 106.

First plenum end plate 308 is attached to the rear side of plenum body plate 310 while second plenum end plate 312 is attached to the forward side of plenum body plate 310. These three plates 308, 310 and 312 are used to form upstream plenum 110. Preferably, second plenum end plate 312 includes a hole that serves as second vapor hole 116. As shown in FIG. 3, second plenum end plate 312 preferably includes first electrode 112 and second electrode 114. Preferably, both first electrode 112 and second electrode 114 are disposed on second plenum end plate 312.

Second plenum end plate 312 is preferably attached to edge thruster plate 802. Preferably, edge thruster plate 802 includes an elbow passage 717 that is used to guide the pressurized vapor from second vapor hole 116 to PPT chamber 718. In this embodiment, PPT chamber 718 extends in a direction that is different than the longitudinal axis of upstream plenum 110. In the embodiment shown in FIG. 8, PPT chamber 718 extends perpendicular to the longitudinal axis of upstream plenum 110 and downwards. PPT chamber 718 is formed by a slot cut into edge thruster plate 802. The sides of the slot form the sidewalls of PPT chamber 718. The upper surface of PPT chamber 718 is formed by front plate 804 and the lower surface of PPT chamber 718 is formed by second plenum end plate 312.

Preferably, first PPT electrode 720 is formed on second plenum end plate 312 and aligned with the slot formed on edge thruster plate 802. Second PPT electrode 722 is preferably formed on front plate 804 and is preferably aligned with first PPT electrode 720 and the slot formed on edge thruster plate 802.

After all of the plates have been assembled, the preferred method of making PPT 700 results in a device that is structural similar to PPT 700 shown in FIG. 7. Any desired fastener and/or adhesive can be used to associate or join the various plates with one another. In some embodiments epoxies are used and in an preferred embodiment prepreg is used to join the various plates together.

Some embodiments include provisions that help to reduce the leakage of fluids or liquids. These provisions can include overlapping copper ridges or electron traces disposed on one or more of the plates. As shown in FIG. 3, back plate 302 can include first copper ridge 320. Preferably, first copper ridge 320 is designed to mate with second copper ridges 322 disposed on vapor supply body plate 304. The first and second copper ridges 320 and 322 are designed to interdigitate with one another in order to help form a fluid seal. Similar copper ridges can be disposed on the forward side of vapor supply body plate 304 and vapor supply body end plate 306. These same copper ridges can also be disposed on any other plate pairs.

Some embodiments include provisions to provide heat to first vapor hole 106. In embodiments that provide a provision for heating first vapor hole 106, heating conductors 324 are provided on first plenum end plate 308. Heating conductors 324 can be used to heat first vapor hole 106 and thereby heat the vapor passing through first vapor hole 106. This can be done to help the vapor achieve a desired temperature and/or pressure prior to reaching upstream plenum 110.

Either of the PPT's disclosed above can be arrayed with other PPT's to form a multiple PPT assembly. In one embodiment, shown in FIG. 10, PPT array 1002 includes multiple PPT's, a first PPT 1006, a second PPT 1010 and a third PPT 1014. Each of the PPT's can receive vapor from an independent vapor supply, however, it is also possible to provide vapor to all of the PPT's in an array from a common vapor supply. In the embodiment shown in FIG. 10, all of the PPT's receive vapor from common vapor supply 1004. The embodiment shown in FIG. 10, which includes three PPT's, is merely exemplary. More or less PPT's can be disposed on PPT array 1002.

Figure 11:
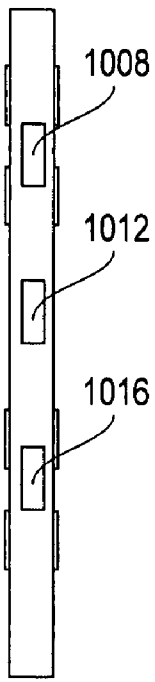
FIG. 11 is a schematic diagram of an end view of a preferred embodiment of an array of PPT's.

Each of the PPT's preferably includes a respective nozzle. FIG. 11 is an end view of PPT array 1002, and referring to FIGS. 10 and 11, nozzles associated with the various PPT's can be observed. First PPT 1006 includes first nozzle 1008, second PPT 1010 includes second nozzle 1012, and third PPT 1014 includes third nozzle 1016.

Using the methods and principles of making PPT's disclosed above, it is possible to conveniently make PPT array 1002. In the embodiment shown in FIG. 10, each of the PPT's are disposed on a common substrate with the other PPT's. In some embodiments, other devices are also mounted onto the common substrate with the PPT's. These other devices can include integrated circuits, silicon chips, surface mount devices, electrical components, or any and other device that can be mounted onto a PCB.

Figure 12:
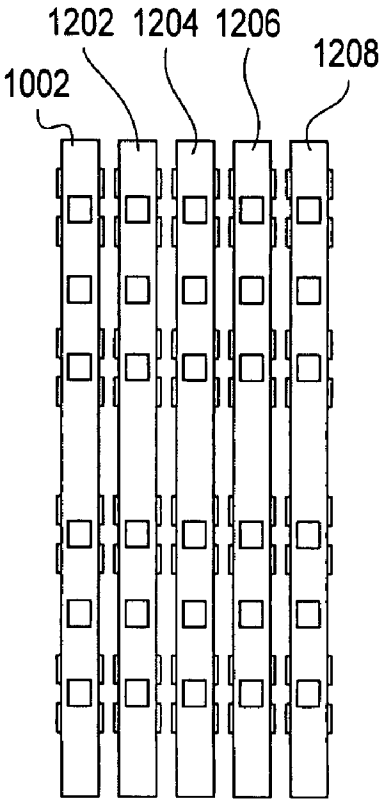
FIG. 12 is a schematic diagram of an end view of a preferred embodiment of an array of PPT's that have been stacked.
Figure 10:
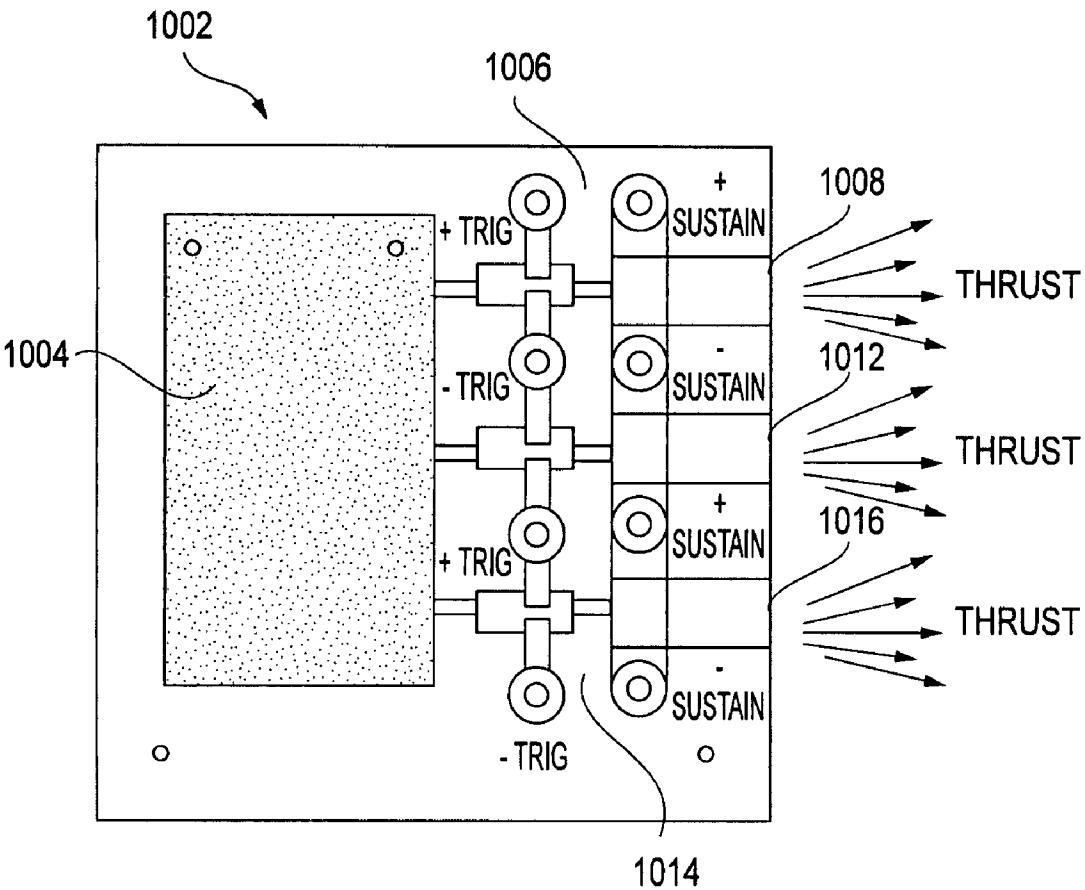
FIG. 10 is a schematic diagram of a preferred embodiment of an array of PPT's.

In some embodiments, multiple PPT arrays are associated to form a stack or series of PPT arrays. This technique can be used to form an X-Y matrix of PPT's. FIG. 12 is a schematic diagram of a preferred embodiment of a stack of PPT arrays. PPT array 1002, as shown in FIGS. 10 and 11, can be combined or stacked with other PPT arrays 1202, 1204, 1206 and 1208. In the embodiment shown in FIG. 12, a total of five PPT arrays are stacked together. Clearly, more or less PPT arrays can be stacked depending on the application and the need for PPT's.

Figure 13:
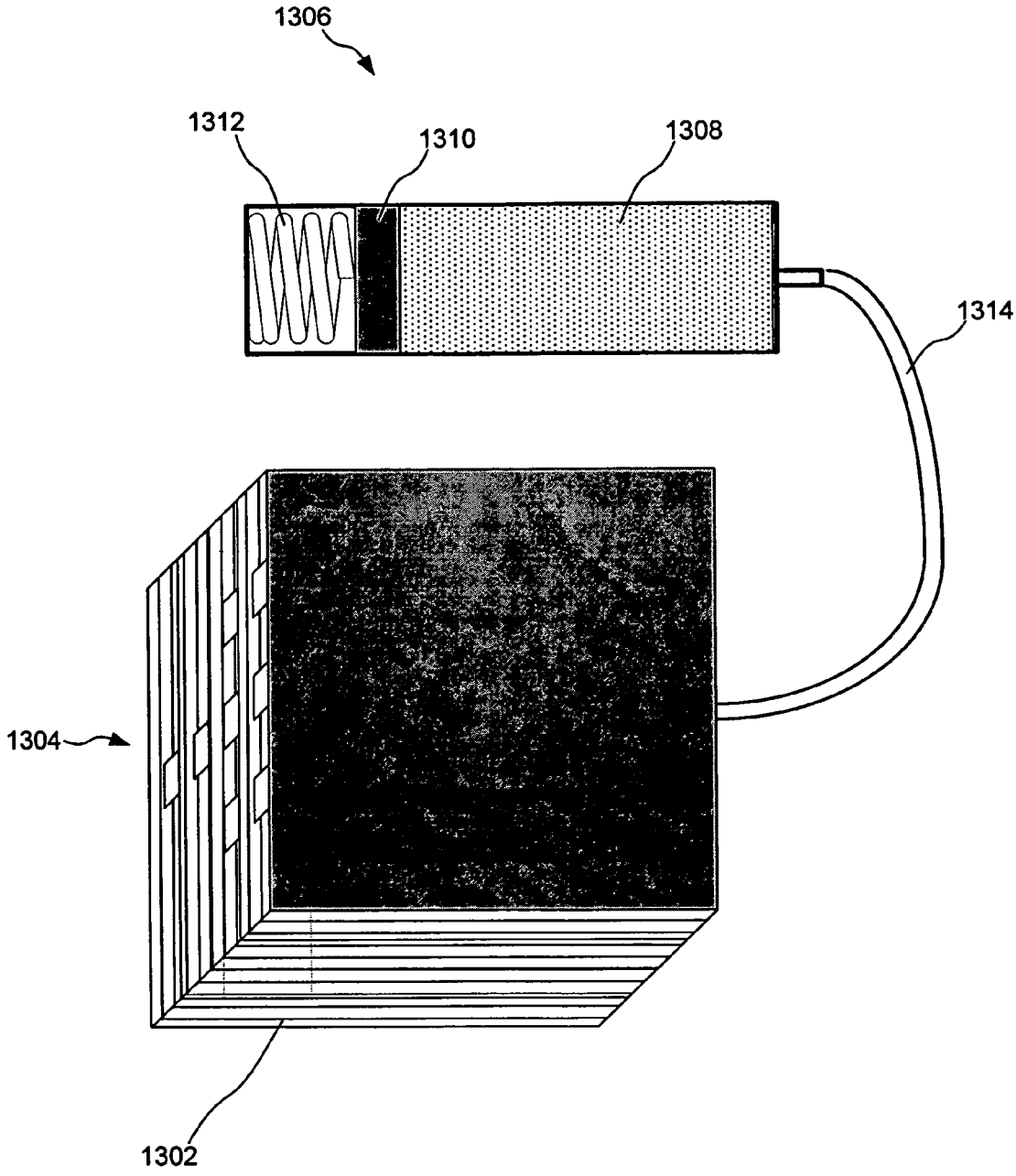
FIG. 13 is a schematic diagram of a preferred embodiment of an array of PPT's with an external fuel supply.

FIG. 13 is a schematic diagram of another embodiment of an array of PPT's. In this embodiment, PPT array 1302 includes a number of PPT's that are vertically and horizontally arrayed. The PPT's can disposed on common substrates or on different substrates. The PPT's provide a nozzle matrix 1304. Any desired matrix or configuration of nozzles can be made using the principles disclosed above.

PPT array 1302 includes an external fuel supply 1306. External fuel supply 1306 includes provisions for delivering fuel to PPT array 1302. In the embodiment shown in FIG. 13, external fuel supply includes a fuel reservoir 1308 that is biased by piston 1310 and spring 1312. Spring 1312 preferably applies pressure to fuel reservoir 1308 by biasing piston 1310 towards fuel line 1314.

Fuel from reservoir 1308 travels through fuel line 1314 and into PPT array 1302. After the fuel has been delivered into PPT array 1302, the fuel can be distributed to the various PPT's. Using this kind of fuel assembly, it is possible to provide fuel to a number of PPT's and if fuel reservoir 1308 becomes depleted, refilling fuel reservoir 1308 can provide additional fuel to multiple PPT'S.

For any of the embodiments disclosed above, any desired liquid can be used to provide vapor. Due to the proximity of the liquid to various sensitive components and conductors, a liquid having generally insulating or non-conducting qualities is preferred. This is because the liquid can act as an insulator and prevent unintended arcing or short circuits. In a preferred embodiment, the liquid fuel can be water, ammonia, or a mixture of the two.

Each of the various components, steps or features disclosed can be used alone or with other components, steps or features. Each of the components, steps or features can be considered discrete and independent building blocks. In some cases, combinations of the components, steps or features can be considered a discrete unit.

While various embodiments of the invention have been described, it will be apparent to those of ordinary skill in the art that may more embodiments and implementations are possible that are within the scope of the invention. Accordingly, the invention is not to be restricted except in light of the attached claims and their equivalents.

What is claimed is:

1. A pulsed plasma thruster (PPT) comprising:

a vapor supply in fluid communication with an upstream plenum through a first vapor hole, the vapor supply providing vapor to the upstream plenum;

a membrane disposed in the first vapor hole configured to provide a pressure difference between the vapor supply and the upstream plenum;

the upstream plenum in fluid communication with a PPT chamber through a second vapor hole; wherein the upstream plenum includes first and second electrodes configured to provide a spark within the upstream plenum; and wherein the PPT chamber includes a first PPT electrode and a second PPT electrode, the first and second PPT electrodes configured to ionize material in the PPT chamber.

2. The PPT according to claim 1, wherein the membrane is made of silver.

3. The PPT according to claim 2, wherein the membrane is made of a sintered silver material.

4. The PPT according to claim 1, wherein the membrane helps to prevent backflow of vapor from the upstream chamber to the vapor supply.

5. The PPT according to claim 1, wherein a longitudinal axis of the PPT chamber is coaxial with the upstream plenum.

6. The PPT according to claim 1, wherein a longitudinal axis of the PPT chamber different than the longitudinal axis of the upstream plenum.

7. The PPT according to claim 1, wherein the first and second PPT electrodes are formed by two bores separating electrode side portions.

8. The PPT according to claim 7, wherein the PPT chamber is formed by two ceramic plugs inserted into the two bores.

9. A method for operating a PPT comprising the steps of:

moving vapor through a first vapor hole, that includes a membrane, and into an upstream plenum;

providing a spark in the upstream plenum to increase the pressure of the vapor and moving the pressurized vapor through a second vapor hole and into a PPT chamber;

ionizing the pressurized vapor in the PPT chamber by utilizing a voltage difference provided by a first PPT electrode and a second PPT electrode to produce plasma; and evacuating the plasma out of the PPT chamber through a PPT nozzle.

10. The method according to claim 9, wherein the spark is provided by a first electrode and a second electrode associated with the upstream plenum.

11. The method according to claim 9, wherein the membrane includes silver.

12. The method according to claim 9, wherein the membrane is made of a sintered silver material.

* * * * *